US011220376B2

(12) United States Patent
Reinhart

(10) Patent No.: US 11,220,376 B2
(45) Date of Patent: Jan. 11, 2022

(54) CONTAINER LID WITH SURFACE FEATURES AND CONNECTING BRIDGES

(71) Applicant: Creative Plastic Concepts, LLC, Sycamore, OH (US)

(72) Inventor: Nickolas Reinhart, Findlay, OH (US)

(73) Assignee: CREATIVE PLASTIC CONCEPTS, LLC, Sycamore, OH (US)

( * ) Notice: Subject to any disclaimer, the term of this patent is extended or adjusted under 35 U.S.C. 154(b) by 1126 days.

(21) Appl. No.: 14/887,383

(22) Filed: Oct. 20, 2015

(65) Prior Publication Data

US 2016/0107803 A1 Apr. 21, 2016

Related U.S. Application Data

(60) Provisional application No. 62/066,612, filed on Oct. 21, 2014.

(51) Int. Cl.
*B65D 43/02* (2006.01)

(52) U.S. Cl.
CPC ..... *B65D 43/0208* (2013.01)

(58) Field of Classification Search
CPC ..... B65D 2543/00398; B65D 2543/00407; B65D 1/42; B65D 1/44; B65D 11/22; B65D 11/24; B65D 43/0208
See application file for complete search history.

(56) References Cited

U.S. PATENT DOCUMENTS

| | | | | | |
|---|---|---|---|---|---|
| 3,653,581 | A * | 4/1972 | Ptak | B65D 55/0854 | 206/497 |
| 3,894,679 | A * | 7/1975 | Reiters | B65D 1/34 | 229/407 |
| D574,150 | S * | 8/2008 | Ross | D3/272 | |
| D648,538 | S * | 11/2011 | Reinhart | B60P 7/04 | D3/318 |
| 8,932,700 | B2 * | 1/2015 | Shimizu | E04C 2/326 | 428/174 |
| D744,239 | S | 12/2015 | Reinhart | | |
| D744,240 | S | 12/2015 | Reinhart | | |
| 9,371,179 | B2 * | 6/2016 | Miller | B65D 19/18 | |

* cited by examiner

*Primary Examiner* — Anthony D Stashick
*Assistant Examiner* — Blaine G Neway
(74) *Attorney, Agent, or Firm* — Jacob M. Ward; Ward Law Office LLC

(57) ABSTRACT

A lid for a container includes a main body having interior portion circumscribed by a lip. A plurality of surface features extend from the interior portion. A plurality of connecting bridges are continuous with and interposed between the surface features. Each of the connecting bridges connects at least two of the surface features to each other. A plurality of guides are formed on the lip. The guides are configured to optimally align a securement device across the lid.

20 Claims, 5 Drawing Sheets

CONTAINER LID WITH SURFACE FEATURES AND CONNECTING BRIDGES

CROSS-REFERENCE TO RELATED APPLICATIONS

This application claims the benefit of U.S. Provisional Application No. 62/066,612, filed on Oct. 21, 2014. The entire disclosure of the above application is hereby incorporated herein by reference.

FIELD

The disclosure generally relates to container lids and, in particular, a lid with strength-enhancing features.

BACKGROUND

Containers with lids are commonly used for commercial or residential applications. It is typical to store articles such as tools, recreational equipment, supplies, materials, and the like in the containers. The lids cover an open end of the container to secure and protect the articles contained within the container.

The containers may be stored or transported in various arrangements such as by stacking the containers on top of or beneath other containers or other objects. However, conventional container lids may not contain sufficient strength or stability to support other containers or objects that may be stacked thereupon. Additionally, the lack of strength or stability of the lid may cause the lid to become warped or damaged during storage or transportation.

It is also known to use cords, straps, or other devices to further secure the lid to the container. However, these means for securing the lid to the container may shift or become misaligned or loose over time. This undesirably permits the lid to become unsecured from the container and expose the contents of the container.

Accordingly, there is a continuing need for a container lid that has sufficient strength and stability to militate against warping or damage during transportation and storage. Desirably, the container lid also facilitates a securing of the lid to the container.

SUMMARY

In concordance with the instant disclosure, a lid for a container that has sufficient strength and stability to militate against warping or damage during transportation and storage, and which desirably facilitates al securing of the lid to the container, has surprisingly been discovered.

In one embodiment, a lid for a container includes main body having an interior portion circumscribed by a lip. The interior portion of the main body has a plurality of raised surface features, a plurality of channels, and a plurality of connecting bridges. The plurality of the raised surface features includes a first surface feature and a second surface feature. The first surface feature is separated from the second surface feature by a first one of the channels. One of the connecting bridges is interposed in the first one of the channels, and couples the first surface feature and the second surface feature together.

In another embodiment, the plurality of raised surface features includes a first surface feature, a second surface feature, a third surface feature, and a fourth surface feature. One of the connecting bridges is interposed in an intersection of the plurality of the channels. The one of the connecting bridges couples each of the first surface feature, the second surface feature, the third surface feature, and the fourth surface feature.

In a further embodiment, the lid further includes a plurality of guides formed on the lip. The guides are configured to align a securement device such as a bungee strap or cord.

DRAWINGS

The above, as well as other advantages of the present disclosure, will become readily apparent to those skilled in the art from the following detailed description, particularly when considered in the light of the drawings described hereafter.

DETAILED DESCRIPTION

Figure 1:
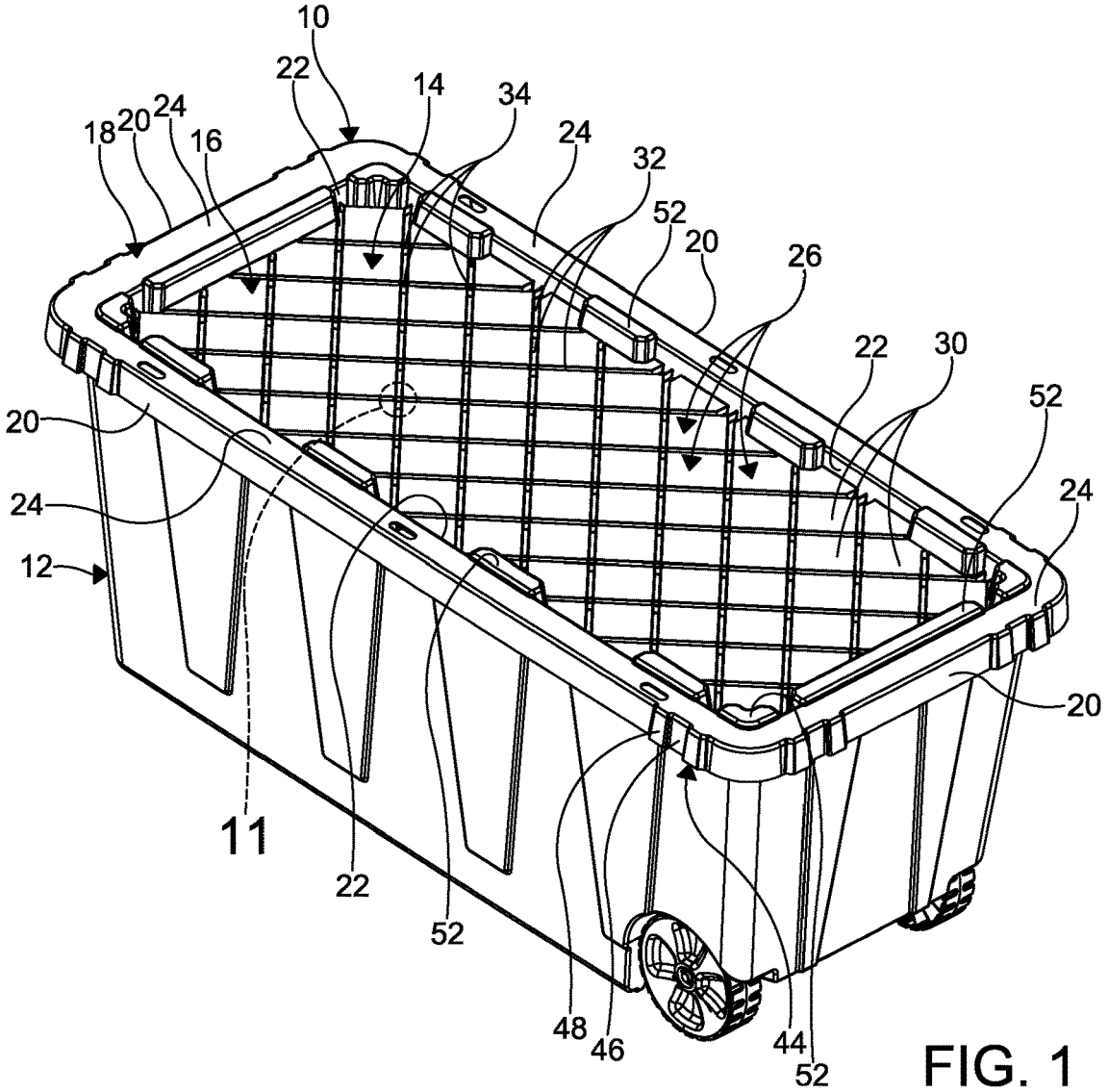
FIG. 1 is a top perspective view of a container assembly including a lid according to one embodiment of the disclosure.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical.

Referring to FIGS. 1-11B, there is illustrated a lid 10 for use with a container 12 for storing articles such as tools, recreational equipment, supplies, materials, and the like. The lid 10 and container 12 may be formed from a polymeric material, such as plastic, by an injection molding process. In alternate embodiments, the lid 10 and container 12 may be formed using other materials, such as a metal or a composite, and by other processes, such as blow molding, as non-limiting examples.

The lid 10 includes a main body 14 having an interior portion 16 circumscribed by a lip 18. In the illustrated embodiment, an outer edge 20, an inner edge 22, and an upper edge 24 of the lip 18 are configured to engage of an open end of the container 12 by receiving a sidewall of the container 12 therein. However, in alternate embodiments, the lip 18 of the lid 10 may be received by a different portion of the container 12. In certain embodiments, the lid 10 has a substantially rectangular shape. However, other shapes can be contemplated to accommodate a respective container shape, such as a square shape, a circular shape, or any polygonal shape, for example.

Referring again to FIGS. 1-11B, a plurality of surface features 26 are formed on at least a portion of the interior portion 16 of the lid 10. As illustrated, the plurality of surface features 26 are disposed in the interior portion 16 of the lid 10. In certain embodiments, the surface features 26 are evenly distributed across the interior portion 16 and terminate at the lip 18 of the lid 10.

In the illustrated embodiments, each of the surface features 26 is a square-shaped boss. However, the surface features 26 can be any shape as desired, such as polygonal, circular, irregular, or a combination thereof, for example. Each of the surface features 26 includes a plurality of corners 28 (shown in FIGS. 8A-8B and 11A-11B) and a substantially planar upper surface 30. The upper surfaces 30 of the surface features 26 are aligned along a common plane with each other, forming a substantially planar upper surface of the interior portion 16.

The surface features 26 may be arranged in a grid, where the surface features 26 are aligned in a series of adjacent rows and columns. In this case, a lattice of channels 32 is formed intermediate the surface features 26. For example, a first plurality of the channels 32 may be arranged perpendicular to a second plurality of the channels 32. In the illustrated embodiment, the grid of the surface features 26 may be diagonally oriented with respect to the inner edge 22 of the lip 18 of the lid 10. More particularly, the surface features 26 and channels 32 may be oriented at a 45 degree angle to the inner edge 22 of the lip 18. In alternate embodiments, other arrangements and orientations may be contemplated, such as a perpendicular oriented grid, a radial array, or an irregular arrangement.

The lid 10 includes a plurality of connecting bridges 34 interposed between the surface features 26 and within the channels 32. The connecting bridges 34 join adjacent surface features 26, providing continuity between the upper surfaces 30 of adjacent surface features 26. As illustrated in FIGS. 1-11B, the connecting bridges 34 may be formed at intersections of the first plurality of the channels 32 and the second plurality of the channels 32. Alternatively, the connecting bridges 34 may be disposed within the channels 32 at any location suitable to connect at least two of the surface features 26 to each other, such as along sides of the surface features 26, for example.

As shown in FIGS. 1-4, the connecting bridges 34 are substantially square- or diamond-shaped, wherein corners 36 of each of the connecting bridges 34 connect the corners 28 of adjacent ones of the surface features 26. In the illustrated embodiment, each of the connecting bridges 34 couples the corners 28 of four adjacent surface features 26. However, in other embodiments the connecting bridges 34 may be any shape suitable to couple the surface features 26 to each other, such as circular, polygonal, or cross-shaped, for example.

Figure 8A:
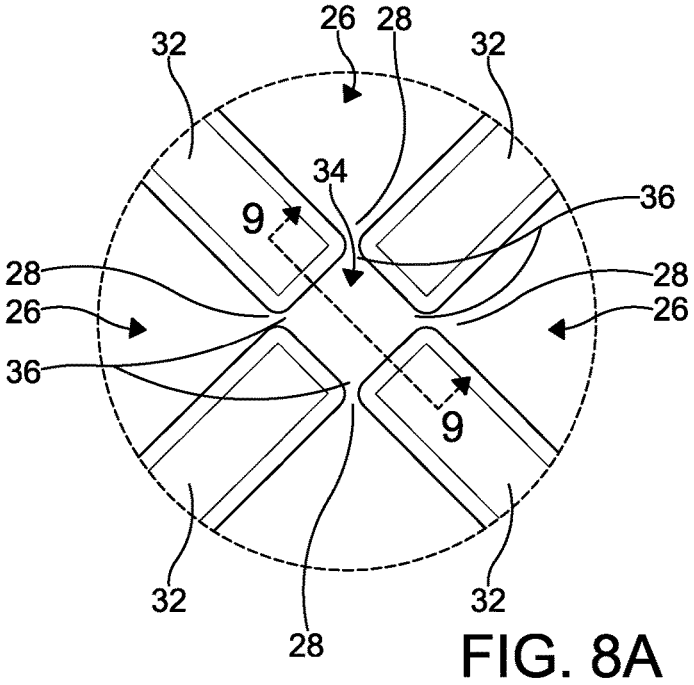
FIG. 8A is an enlarged, fragmentary top plan view of the lid according to a first embodiment of the disclosure, and taken at area 8 in FIG. 3.
Figure 9:
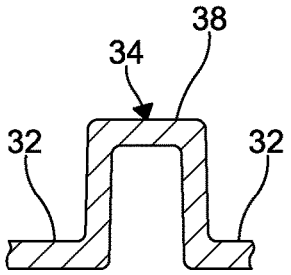
FIG. 9 is an enlarged, fragmentary cross-sectional elevational view the lid taken along section line 9-9 in FIG. 8A, and showing a connecting bridge according to the first embodiment of the disclosure.
Figure 11A:
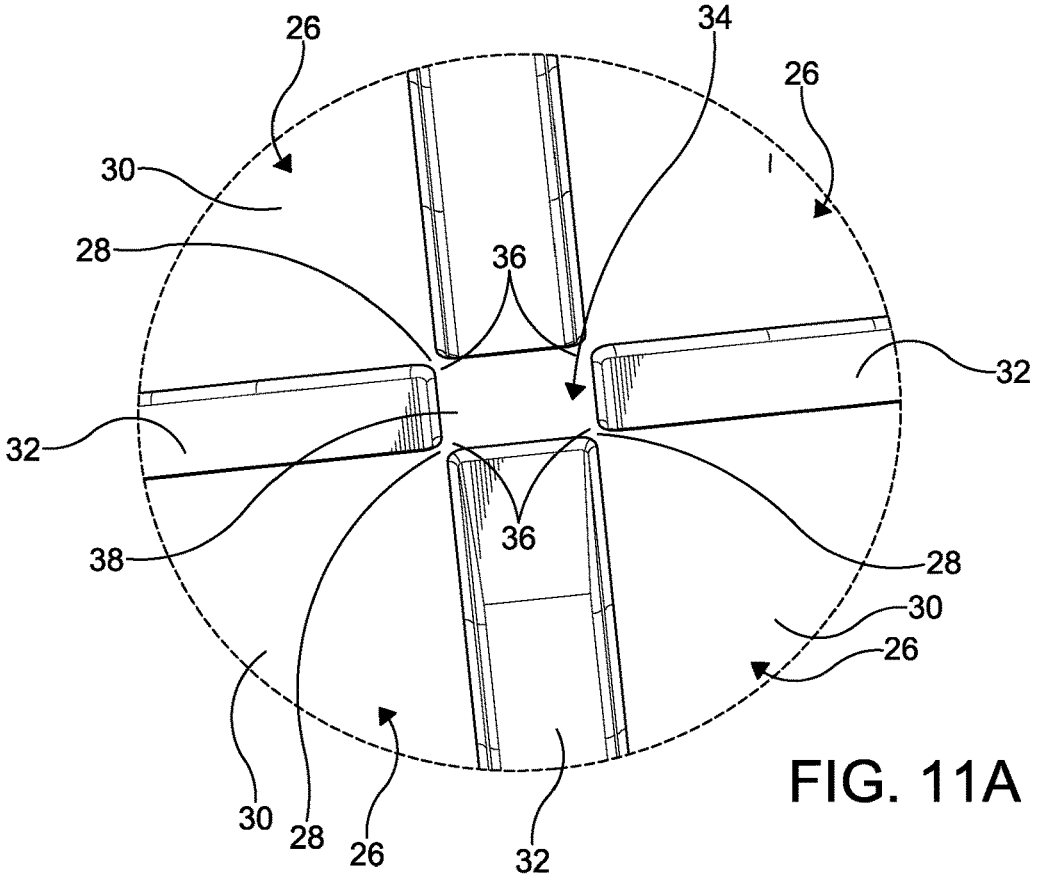
FIG. 11A is an enlarged, fragmentary perspective view of the connecting bridge for the lid shown in FIG. 8A.

In one embodiment of the lid 10, shown in FIGS. 8A, 9, and 11A, an upper surface 38 of each of the connecting bridges 34 is continuously formed and coplanar with the upper surfaces 30 of adjacent surface features 26, forming a continuous connection between adjacent surface features 26. As detailed in FIGS. 8A, 9, and 11A, the connecting bridges 34 are continuous bodies formed with the corners of four adjacent surface features 26. In alternate embodiments, the upper surfaces 38 of the connecting bridges 34 may be offset from the upper surfaces 30 of the surface features 26.

Figure 8B:
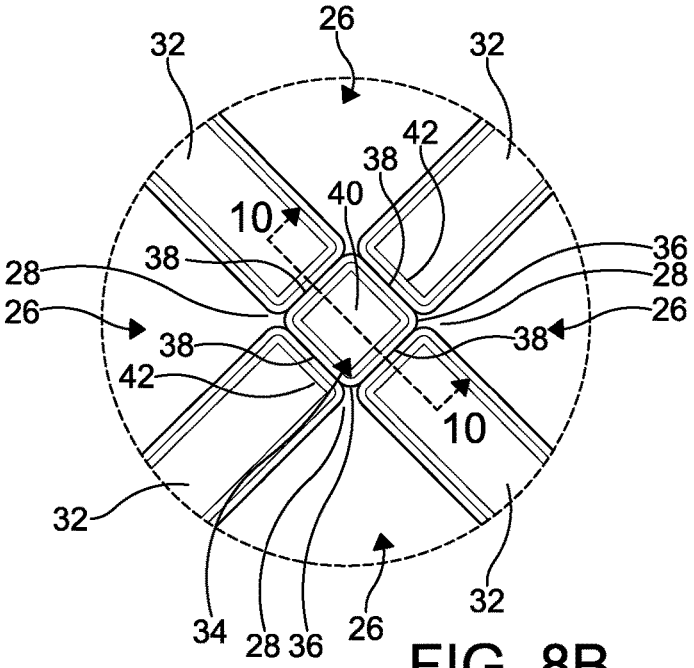
FIG. 8B is an enlarged, fragmentary top plan view of the lid according to a second embodiment of the disclosure, and taken at area 8 in FIG. 3.
Figure 10:
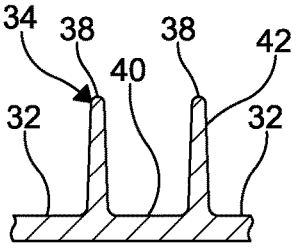
FIG. 10 is an enlarged, cross-sectional elevational view of the lid taken along section line 10-10 in FIG. 8B, and showing a connecting bridge according to the second embodiment of the disclosure.
Figure 11B:
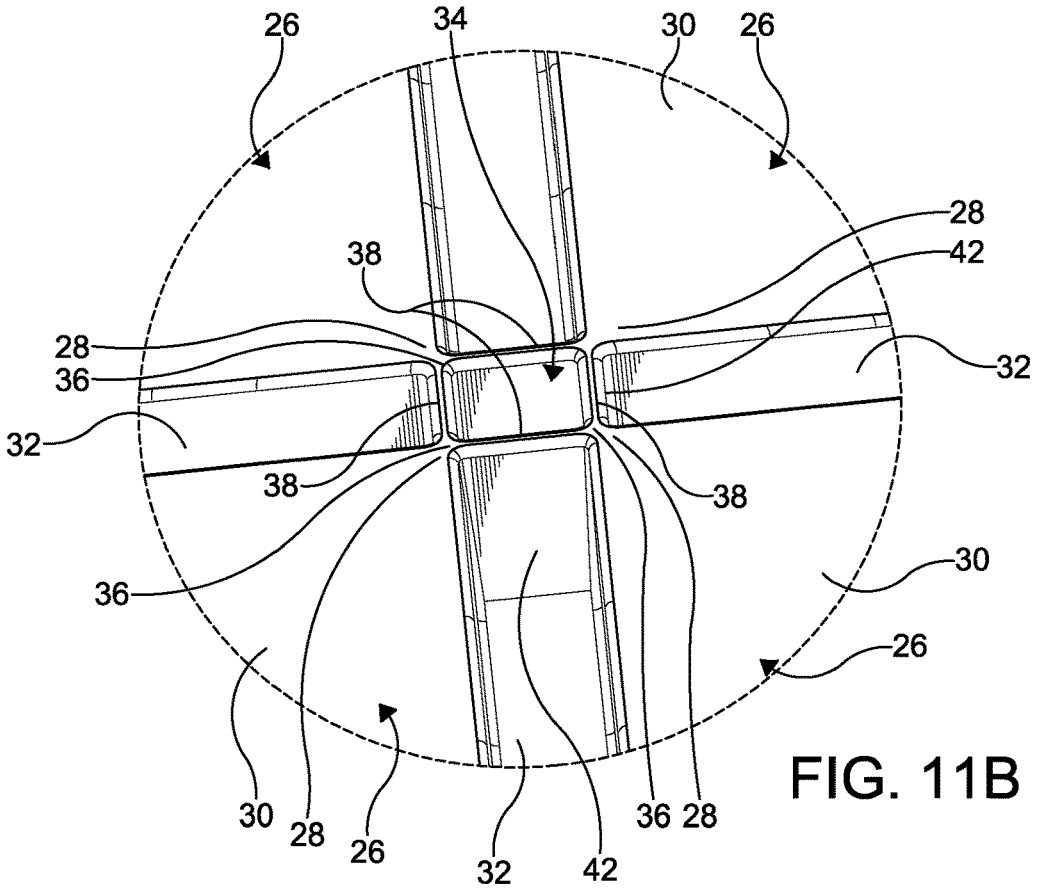
FIG. 11B is an enlarged, fragmentary perspective view of the connecting bridge for the lid shown in FIG. 8B.

In another embodiment of the lid 10, shown in FIGS. 8B, 10, and 11B, the connecting bridges 34 include box-shaped cavities 40 formed in the upper surfaces 38 thereof. The cavities 40 are circumscribed by a plurality of sidewalls 42. Each of the sidewalls 42 spans one of the channels 32 to connect at least two of the adjacently formed surface features 26. As detailed in FIGS. 8B, 10, and 11B, the cavities 40 of the connecting bridges 34 are circumscribed by four sidewalls 42, each of the sidewalls 42 spanning one of the channels 32 to connect the corners 36 of the adjacent surface features 26. However, in alternate embodiments, more or less sidewalls 42 may circumscribe the cavity 40, and the sidewalls 42 may be spaced a distance from the corners of the surface features 26.

Advantageously, the connecting bridges 34 impart additional strength and stability to the lid 10 to militate against deformation such as bending, warping, or damage while being stored, or transported with the container 12. The connecting bridges 34 also provide strength to the lid 10 when attaching and detaching the lid 10 to the container 12. Relative to known lids without the connecting bridges 34, the connecting bridges 34 provide improved rigidity and strength by inhibiting relative movement between adjacently formed surface features 26, thereby stiffening the interior portion 16 of the lid 10 as a whole.

As illustrated in FIGS. 1-6, the lid 10 also includes at least one guide 44 formed on the lip 18 of the lid 10. The guide 44 includes a recess 46 formed intermediate a pair of protuberances 48 extending from the outer edge 20 of the lip 18. The recess 46 of the guide 44 is configured to receive and retain a portion of a securement device 50 (shown in FIG. 2), such as a bungee cord, rope, strap, or other fastening device, to facilitate securement of the lid 10 to the container 12.

The lid 10 may include any number of guides 44 formed thereon, as desired, for optimal securement. In a non-limiting example, and as illustrated in FIGS. 1-6, the lid 10 includes eight guides 44 formed on the outer edges 20 of the lip 18, wherein each of the outer edges 20 includes a pair of guides 44 disposed at opposing ends thereof. Each of the guides 44 on a first one of the outer edges 20 is aligned with one of the guides on an opposing one of the outer edges 44. Each of the guides 44 may be disposed adjacent one of the corners of the lid 10, where each corner of the lid 10 includes a pair of guides 44 formed cater-cornered to each other. Alternately, the guides 44 may be formed in any position along the outer edge 20, as desired. In other examples, the lid 10 may include two guides, four guides, six guides, or ten guides arranged at any position along the edges of the lip 18 of the lid 10. It will also be appreciated that guides 44 may be formed along any one of the outer edge 20, the inner edge 22, or the upper edge 24.

With continuing reference to FIGS. 1-6, a plurality of bosses 52 may be formed on the inner edges 20 of the lip 18 of the lid 10. In the illustrated embodiment, at least one boss 52 is formed along each of the inner edges 20 of the lip 18. The lid 10 may further include at least one boss 52 disposed in a corner of the lip 18 formed by adjacent and converging inner edges 20. The bosses 52 extend from the upper surfaces 30 of the surface features 26 of the lid 10 and protrude beyond the upper edge 24 of the lip 18 of the lid 10. The bosses 52 are configured to cooperate with the guides 44 to maintain an alignment of the securement device 50 across the lid 10 for fastening the lid 10 to the container 12. In the illustrated embodiment, spaces 54 formed intermediate each of the bosses 52 may be substantially aligned across the upper edge 24 with corresponding ones of the recesses 46 of the guides 44.

In application, a first end of the securement device 50 is received by at least one of the recesses 46 of the guides 44. The securement device 50 may extend partially around one or more of the bosses 52 to secure the lid 10 to the container 12. The bosses 52 facilitate positioning the securement device 50 over the lid 10 in optimal positions to militate against concentrated deformations or bowing of the lid 10.

Figure 2:
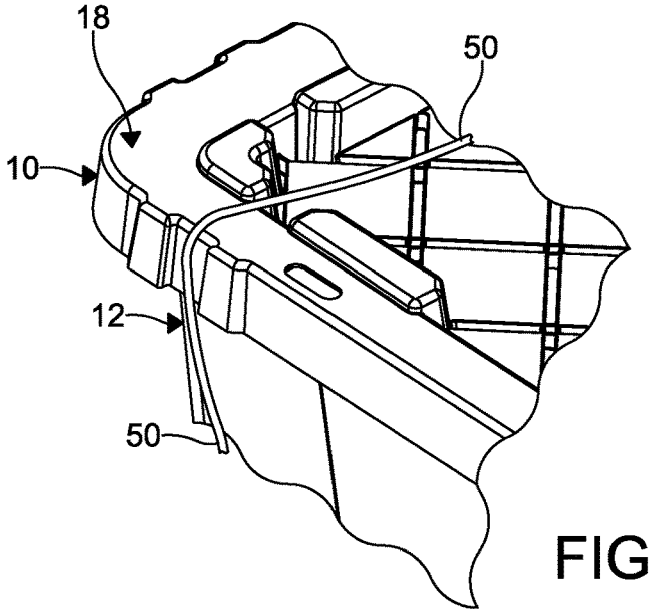
FIG. 2 is a fragmentary top perspective view of the container assembly shown in FIG. 1, and further showing means for securing the lid to the container, the means aligned by guide features of the lid.
Figure 3:
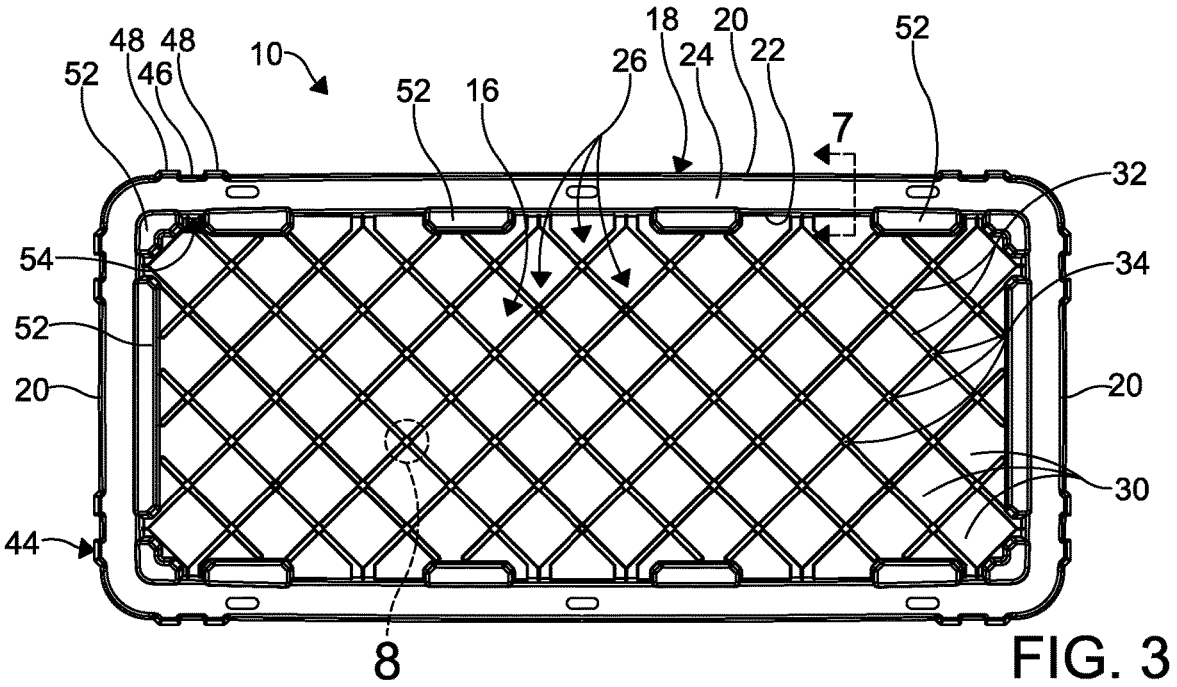
FIG. 3 is a top plan view of the lid shown in FIG. 1.
Figure 4:
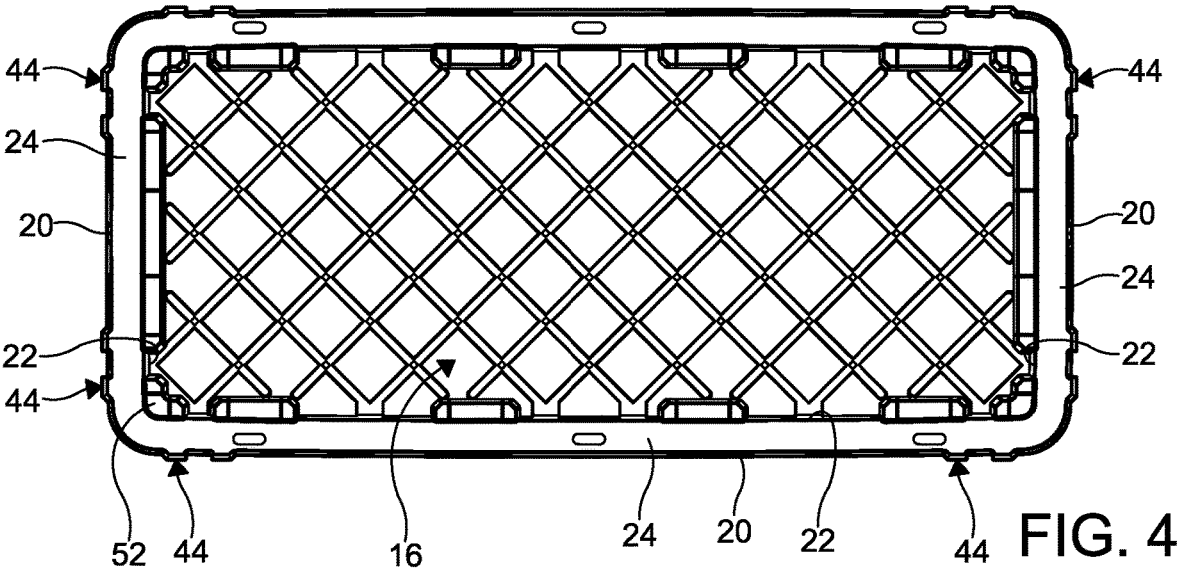
FIG. 4 is a bottom plan view of the lid shown in FIG. 1.
Figure 5:
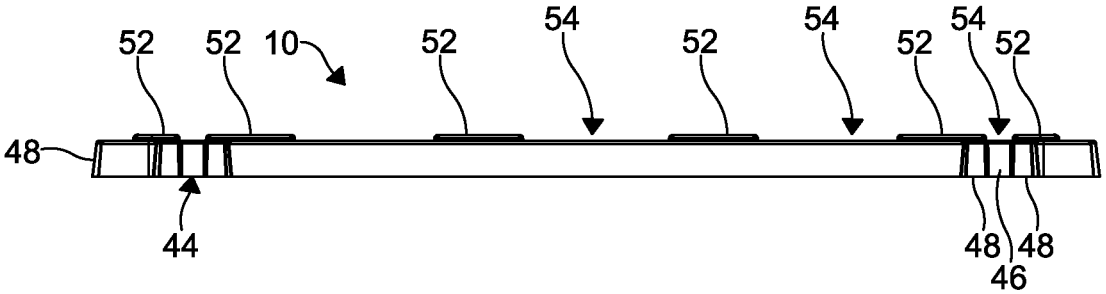
FIG. 5 is a front elevational view of the lid shown in FIG. 1.
Figure 6:
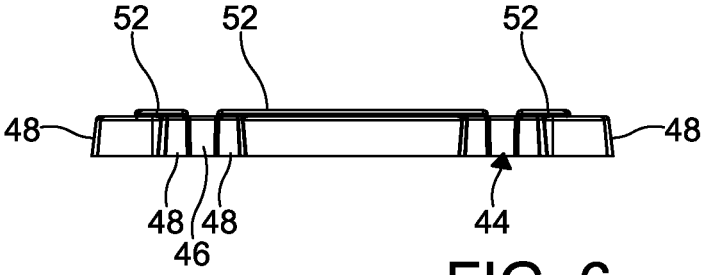
FIG. 6 is a side elevational view of the lid shown in FIG. 1.
Figure 7:
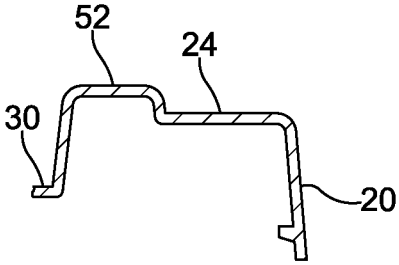
FIG. 7 is an enlarged, fragmentary cross-sectional elevational view of the lid taken along section line 7-7 of FIG. 3.

Referring now to FIGS. 1 and 2, it should be understood that in application the lid 10 releasably connects to the container 12. The securement devices 50 can be coupled to the container 12 and guided over the lid 10 with the assistance of the guides 44 and the bosses 52. As shown, at least one of the securement devices 50 may encompass the container 12, wherein the securement device 50 is received by the guides 44 on opposing sides of the lid. Hooks (not shown) disposed on the securement device 50 may engage may cooperate with each other or with the container 12 to secure the lid to the container 12. It will be appreciated that the securement devices 50 may cooperate with any number of guides 44 and bosses 52 to secure the lid 10 to the container 12. For example, the securement devices 50 may cooperate with a corner one of the bosses 52 and cater-cornered ones of the guides 44, wherein the securement device secures the four corners of the lid 10 to the container 12.

The lid 10 can cooperate with any container 12 as desired such as a 55-gallon container, a 27-gallon container, a 17-gallon container, etc. Additionally, the lid 10 can be completely detachable from the container 12 or coupled to the container 12, such as hingedly coupled to the container 12, for example.

While certain representative embodiments and details have been shown for purposes of illustrating the invention, it will be apparent to those skilled in the art that various changes may be made without departing from the scope of the disclosure, which is further described in the following appended claims.

What is claimed is:

1. A lid for a container, comprising:

a main body having an interior portion circumscribed by a lip, the interior portion having a plurality of raised surface features, a plurality of channels, and a plurality of connecting bridges, the raised surface features including a first surface feature and a second surface feature, the first surface feature separated from the second surface feature by a first one of the channels, and one of the connecting bridges interposed in and extending outwardly from the first one of the channels and coupling the first surface feature and the second surface feature, wherein the one of the connecting bridges joins and provides continuity between an upper surface of the first surface feature and an upper surface of the second surface feature, and an upper surface of the connecting bridge is coplanar with the upper surfaces of the first surface feature and the second surface feature, wherein a third surface feature and a fourth surface feature are disposed adjacent the first surface feature and the second surface feature, each of the first surface feature, the second surface feature, the third surface feature, and the fourth surface feature are coupled with the connecting bridge.

2. The lid of claim 1, wherein the upper surface of the connecting bridge includes a cavity formed therein.

3. The lid of claim 1, wherein each of the raised surface features has a corner, and the corner of the first surface feature is coupled to the corner of the second surface feature with the connecting bridge.

4. The lid of claim 1, wherein each of the surface features is quadrilateral in shape.

5. The lid of claim 1, wherein the first surface feature, the second surface feature, the third surface feature, and the fourth surface feature are arranged in a grid, the third surface feature being separated from the fourth surface feature by the first one of the channels, the first surface feature and the second surface feature being separated from the third surface feature and a fourth surface feature by a second one of the channels, the first one of the channels arranged perpendicular to the second one of the channels.

6. The lid of claim 5, wherein each of the raised surface features has a corner, and the corners of each of the first surface feature, the second surface feature, the third surface feature, and the fourth surface feature are coupled with the connecting bridge.

7. The lid of claim 1, further comprising a plurality of guides formed on the lip, the guides configured to align a securement device.

8. A lid for a container, comprising:

a main body having an interior portion circumscribed by a lip, the interior portion having a plurality of raised surface features, a plurality of channels, and a plurality of connecting bridges, the raised surface features including a first surface feature, a second surface feature, a third surface feature, and a fourth surface feature, one of the connecting bridges interposed in and extending outwardly from an intersection of the plurality of the channels and coupling each of the first surface feature, the second surface feature, the third surface feature, and the fourth surface feature, wherein the one of the connecting bridges joins and provides continuity between an upper surface of the first surface feature, an upper surface of the second surface feature, an upper surface of the third surface feature, and an upper surface of the fourth surface feature, and an upper surface of the connecting bridge is coplanar with the upper surfaces of the first surface feature, the second surface feature, the third surface feature, and the fourth surface feature.

9. The lid of claim 8, wherein the upper surface of the connecting bridge further includes a cavity formed therein.

10. The lid of claim 8, wherein each of the raised surface features includes a corner, and the corner of each of the first surface feature, the second surface feature, the third surface feature, and the fourth surface feature is coupled with the connecting bridge.

11. The lid of claim 8, wherein the first surface feature, the second surface feature, the third surface feature, and the fourth surface feature are arranged in a grid, the first surface feature and the third surface feature being separated from the second surface feature and the fourth surface feature by a first one of the channels, and the first surface feature and the second surface feature being separated from the third surface feature and the fourth surface feature by a second one of the channels, the first one of the channels arranged perpendicular to the second one of the channels.

12. The lid of claim 8, further comprising a plurality of guides formed on the lip, the guides configured to align a securement device.

13. A lid for a container, comprising:

a main body having an interior portion circumscribed by a lip, the interior portion having a plurality of raised surface features, a plurality of channels, and a plurality of connecting bridges; and a plurality of guides formed on the lip, the guides configured to align a securement device, the raised surface features including a first surface feature, a second surface feature, a third surface feature, and a fourth surface feature, and one of the connecting bridges interposed in and extending outwardly from the plurality of the channels and coupling each of the first surface feature, the second surface feature, the third surface feature, and the fourth surface feature, wherein the one of the connecting bridges joins and provides continuity between an upper surface of the first surface feature, an upper surface of the second surface feature, an upper surface of the third surface feature, and an upper surface of the fourth surface feature, and an upper surface of the connecting bridge is coplanar with the upper surfaces of the first surface feature, the second surface feature, the third surface feature, and the fourth surface feature.

14. The lid of claim 13, wherein the lid further comprises a plurality of bosses formed on an inner edge of the lip.

15. The lid of claim 1, wherein a surface area of the upper surface of the connecting bridge is less than a surface area of the upper surface of each of the first surface feature and the second surface feature.

16. The lid of claim 8, wherein a surface area of the upper surface of the connecting bridge is less than a surface area of the upper surface of each of the first surface feature, the second surface feature, the third surface feature, and the fourth surface feature.

17. The lid of claim 13, wherein a surface area of the upper surface of the connecting bridge is less than a surface area of the upper surface of each of the first surface feature, the second surface feature, the third surface feature, and the fourth surface feature.

18. The lid of claim 1, wherein each one of the raised surface features and each one of the channels are oriented at a 45 degree angle relative to the inner edge of the lip.

19. The lid of claim 18, wherein the plurality of channels includes a first plurality of the channels that are arranged perpendicular to a second plurality of the channels, each one of the connecting bridges is formed at an intersection of one of the channels of the first plurality of the channels and one of the channels of the second plurality of the channels.

20. A container having the lid of claim 1 coupled thereto.

* * * * *